US011993456B2

(12) United States Patent
Nguyen

(10) Patent No.: US 11,993,456 B2
(45) Date of Patent: May 28, 2024

(54) CARGO CONTAINERS HAVING MULTI-LEVELS AND MULTIPLE INDEPENDENTLY OPENED AND CLOSED SIDE DOORS ENABLING PARALLEL MERCHANDISE LOADING

(71) Applicant: Khanh Tuan Nguyen, Ho Chi Minh (VN)

(72) Inventor: Khanh Tuan Nguyen, Ho Chi Minh (VN)

( * ) Notice: Subject to any disclaimer, the term of this patent is extended or adjusted under 35 U.S.C. 154(b) by 0 days.

(21) Appl. No.: 17/650,078

(22) Filed: Feb. 5, 2022

(65) Prior Publication Data

US 2022/0250833 A1 Aug. 11, 2022

(30) Foreign Application Priority Data

Feb. 5, 2021 (VN) ..... 1-2021-00679

(51) Int. Cl.

| | |
|---|---|
| ***B65D 90/62*** | (2006.01) |
| ***B65D 88/74*** | (2006.01) |
| ***B65D 90/66*** | (2006.01) |

(52) U.S. Cl.

CPC ..... *B65D 90/623* (2013.01); *B65D 88/745* (2013.01); *B65D 90/66* (2013.01); *B65D 2590/547* (2013.01); *B65D 2590/664* (2013.01)

(58) Field of Classification Search

CPC .. B65D 90/62; B65D 90/623; B65D 90/0086; B65D 90/008; B65D 90/626; B65D 90/64; B65D 90/66; B65D 90/58; B65D 90/582

See application file for complete search history.

(56) References Cited

U.S. PATENT DOCUMENTS

| | | | | |
|---|---|---|---|---|
| 3,672,529 | A * | 6/1972 | Feddersen | B65D 88/14 292/281 |
| 2015/0375932 | A1* | 12/2015 | Anderson, III | B65D 88/745 73/863.11 |
| 2021/0292207 | A1* | 9/2021 | Logan | C02F 11/122 |

* cited by examiner

*Primary Examiner* — Anthony D Stashick
*Assistant Examiner* — Raven Collins

(57) ABSTRACT

A cargo container is disclosed which contains a bottom side; a front side; a back side; a central frame connected to the front side, the back side, and the bottom side, dividing the cargo container into a multiple storing areas; a left top wing-shaped door, hingedly connected to a top of the central frame, operable to open and close down to one and a half height to the central frame; a left bottom wing-shaped door, hingedly connected at a one and a half height of the central frame; a right top door, hingedly to the said half height distance to the mid-section frame; and a right bottom door, hingedly connected to the central frame at the one and a half height of the central frame and close down to the bottom side.

20 Claims, 6 Drawing Sheets

CARGO CONTAINERS HAVING MULTI-LEVELS AND MULTIPLE INDEPENDENTLY OPENED AND CLOSED SIDE DOORS ENABLING PARALLEL MERCHANDISE LOADING

FIELD OF THE INVENTION

The present invention relates generally to the field of a shipping container used for shipping freight over land and sea. More specifically, the present invention relates to a shipping container having multiple doors and corresponding compartments that enable parallel loading.

BACKGROUND ART

Today the transport of merchandises using shipping containers from one place to another is very common. The shipping containers may be transported by different methods such as trains, trans-oceanic ships, and eighteen wheeler, and semi-trailer trucks. Conventionally, the loading and unloading of merchandises encounter many difficulty since the shipping containers have only one loading side at its back door. Consequently, merchandises are usually loaded serially into the enclosed storage area beginning at the cabin end toward the back door. This takes time and increases the chances of breaking especially breakable merchandises. There are some containers having sliding doors on the side along the length of the detachable semi-trailer that solve some of the above problems.

However, in the cargo space of the sliding door containers, merchandises must be stacked on top of one another. This tends to destroy the bottom cargo especially the liquid products such as milk cartons and beverage bottles and cans. Furthermore, the internal temperatures of long distanced containers can cause some merchandises such as medicines, fruits, and foods to perish.

Therefore, what is needed is a container capable of parallel loading merchandizes from the sides of the container.

What is needed is a container capable of supporting soft packaged merchandises such as milk and egg cartons.

What is needed is a container capable of maintaining a constant internal temperature so that perishable merchandises can be kept safe.

The container of the present invention solves the above problems and meets the needs of container uses.

SUMMARY OF THE INVENTION

The present invention has been made in view of the aforementioned circumstances, and therefore, an object of the present invention is to provide a novel laboratory grinder designed to prevent cross contamination among samples.

An object of the present invention is to provide a shipping container is disclosed which contains a bottom frame; a front frame; a back side; a central frame connected to the front frame, the back side, and the bottom frame, dividing the shipping container into a multiple storing areas; a left top wing-shaped door, hingedly connected to a top of the central frame, operable to open and close down to one and a half height to the central frame; a left bottom wing-shaped door, hingedly connected at a one and a half height of the central frame; a right top door, hingedly to the said half height distance to the mid-section frame; and a right bottom door, hingedly connected to the central frame at the one and a half height of the central frame and close down to the bottom frame.

An object of the present invention is to provide a shipping container that includes multiple side doors that allow parallel loading of merchandises.

Another object of the present invention is to provide a shipping container that has a plurality of storing compartments formed by the multiple side doors and the central frame.

Another object of the present invention is to provide a shipping container that includes a cooling system configured to prevent the merchandise from perishing.

The above objectives are achieved by providing a method of manufacturing an efficient and cross-contamination free laboratory sample grinder which comprises: (a) preparing ejecting means for ejecting an array of pestles into an array of mortars; (b) calculating distances between the pestles in the array of pestles, and those between mortars in the array of mortars; and (c) preparing a locking means so that when the grinder is in the lock state the array of pestles, the array of mortars, and the ejecting means are lined up.

These and other advantages of the present invention will no doubt become obvious to those of ordinary skill in the art after having read the following detailed description of the preferred embodiments, which are illustrated in the various drawing Figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
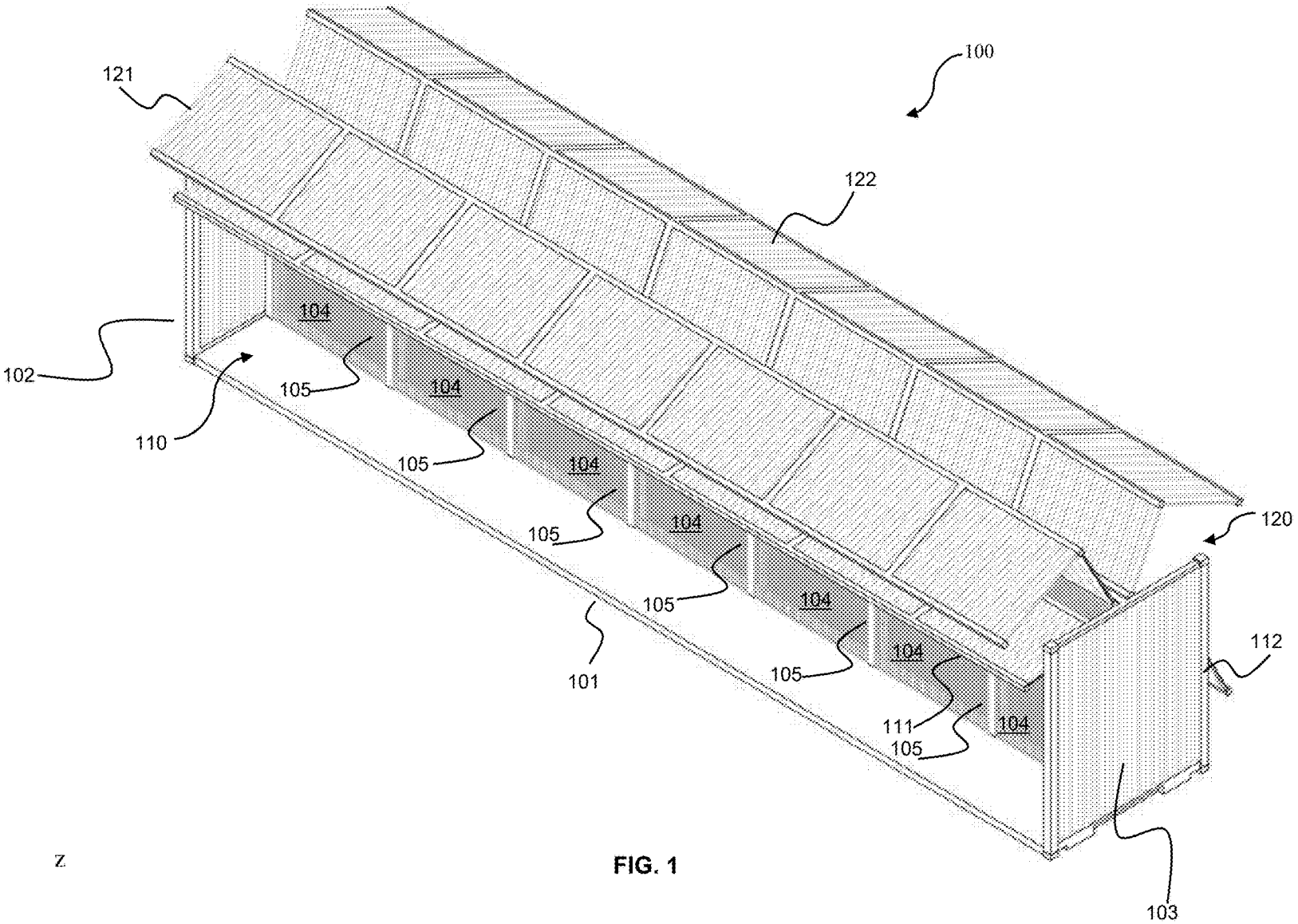
FIG. 1 is a 3D diagram illustrates a collapsible container having multi-level and multiple loading doors in accordance with an exemplary embodiment of the present invention.

Now referring to FIG. 1, a 3D diagram of a shipping container 100 having multiple side loading doors and a multiple storage areas in accordance with an exemplary embodiment of the present invention is illustrated. Shipping container 100 has a shape of a cuboid (rectangular prism) with a predetermined length L, width W, and height H. In many embodiments of the present inventions, the predetermined length L, width W, and height H are those of standard cargos. The predetermined lengths L can be either 20 ft or 40 ft. The predetermined width is 8 ft, and the predetermined height H is either 8.6 ft or 9.6 ft. On the outside, shipping container 100 includes a bottom frame 101, a front frame 102, a back frame 103, a left bottom wing-shaped door 111, a right bottom wing-shaped door 112, a left top wing-shaped door 121, and a right top wing-shaped door 122, all mechanically connected to a central dividing frame 104. Central dividing frame 104 is divides bottom frame 101 into two equal storing halves and has a height H equals to that of shipping container 100. Left top wing-shaped door 121 and right top wing-shaped door 122 are hingedly connected to the top of central dividing frame 104 while left bottom wing-shaped door 111 and right bottom wing-shaped door 112 are hingedly connected to the middle of central dividing frame 104. Left top wing-shaped door 121 and right top wing-shaped door 122 are dimensioned so that when in close position they contact the top sides of left bottom wing-shaped door 111 and right bottom wing-shaped door 112 respectively. In turn, left bottom wing-shaped door 111 and right bottom wing-shaped door 112 are dimensioned so that when in close position they contact bottom frame 101. When all are in the close position, left bottom wing-shaped door 111, right bottom wing-shaped door 112, left top wing-shaped door 121, and right top wing-shaped door 122 form a standardized cuboid shipping container 100 as described above.

Figure 2:
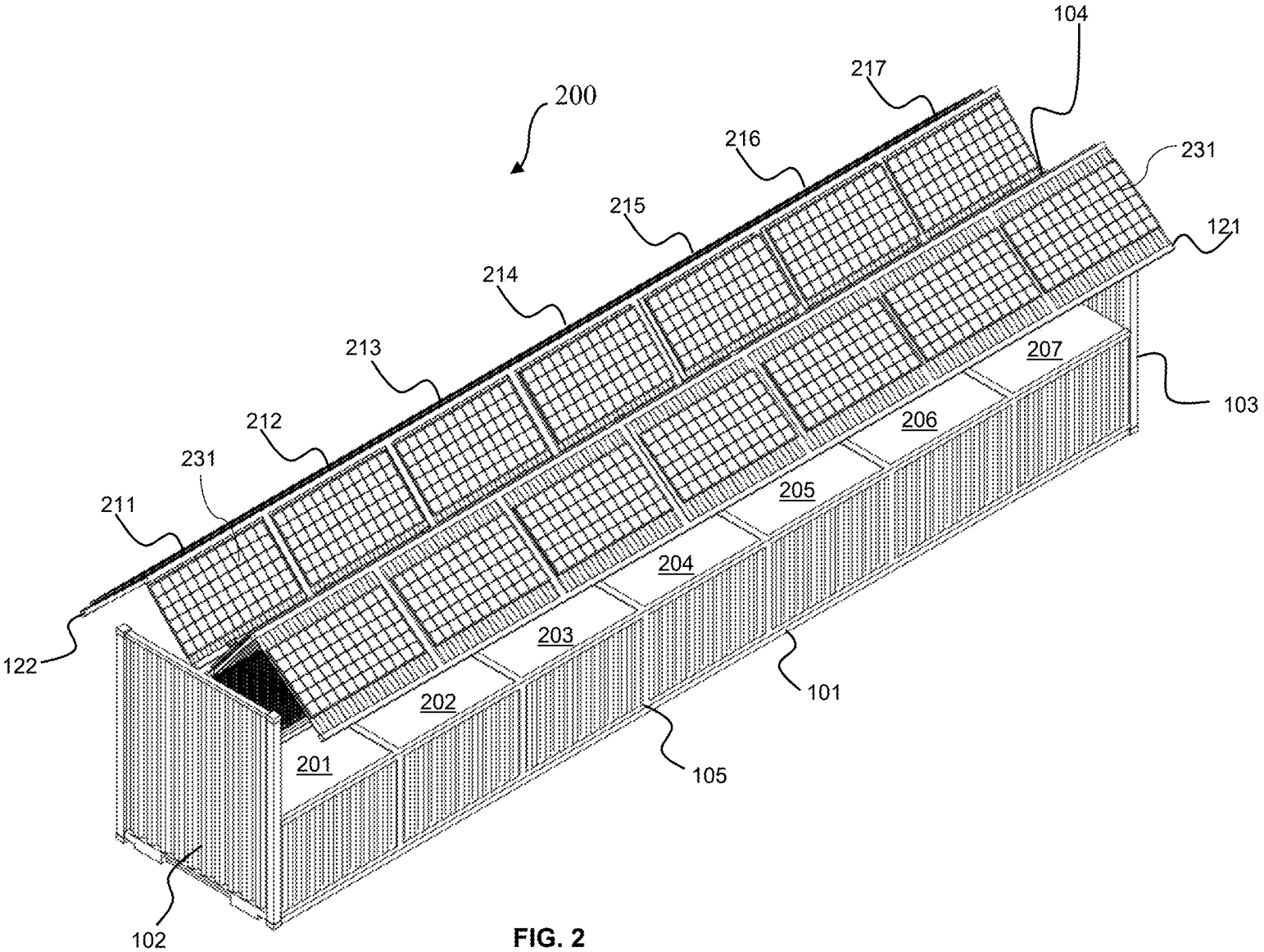
FIG. 2 is a 3D diagram illustrating the independent opening/closing of the multiple side doors of the shipping container with solar panels for land transportation in accordance with an exemplary embodiment of the present invention.

Next referring to FIG. 2, another embodiment of the present invention is shown. FIG. 2 illustrates the independent opening/closing of the multiple side doors of the shipping container 200 with solar panels for land transportation. The exterior surface areas of top left wing-shaped door 121 and top right wing-shaped door 122 are equipped with solar panels 231. In this embodiment, shipping container 200 is used in land transportation by eighteen wheeler trucks or sixteen wheeler trucks only. The energy harvested by solar panels 231 is used to keep the cargo such as meat products, vegetable produces, milk cartons, and vaccines refrigerated. In another aspect of the present invention, left bottom wing-shaped door 111, right bottom wing-shaped door 112, left top wing-shaped door 121, and right top wing-shaped door 122 are divided by independently closed and opened because of they are hingedly connected to central dividing frame 104. As such, when in the close position, left bottom wing-shaped door 111 and right bottom wing-shaped door 112 form first level storage areas such as bottom storage compartment 201-207. Their top surface areas (of left bottom wing-shaped door 111 and right bottom wing-shaped door 112) are used as bases for second level storage areas such as top storage compartments 211-217.

Figure 3B:
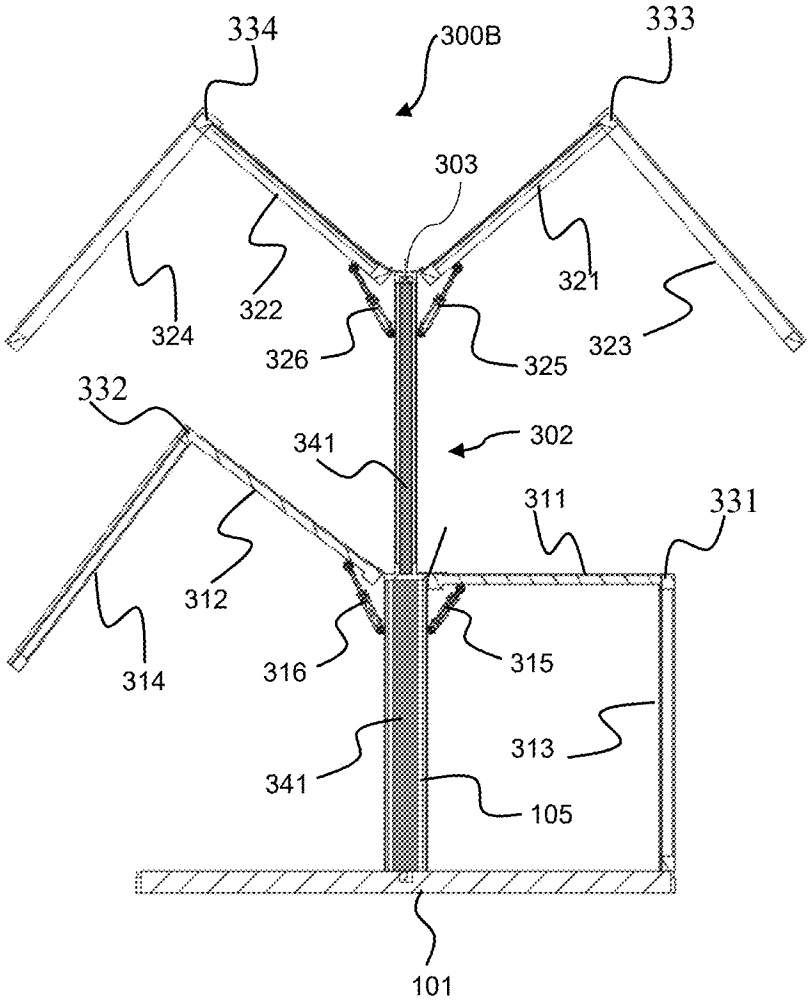
FIG. 3B is a 2D diagram illustrating the frame structure of the container in accordance with an exemplary embodiment of the present invention.
Figure 3A:
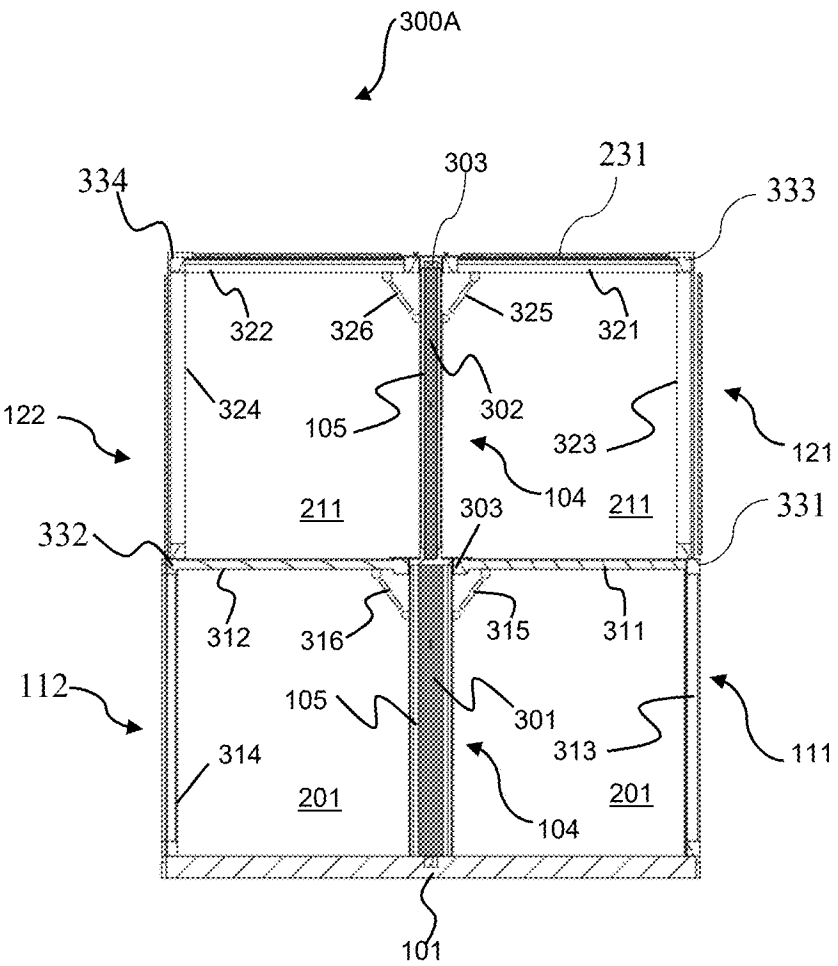
FIG. 3A is a 2D diagram of the container illustrating internal structure of the shipping container having a multiple storage areas in accordance with an exemplary embodiment of the present invention.

Now referring to FIG. 3A-FIG. 3B, an internal structure 300A of the shipping container 100 having a multiple storage areas in accordance with an exemplary embodiment of the present invention is illustrated. Central dividing frame 104 further comprises a bottom frame segment 301 and a top frame segment 302. In different embodiments of the present invention, top frame segment 302 has the same height H/2 but a greater thickness T than bottom frame segment 301. Left bottom wing-shaped door 111 has a first section 311 fixedly connected to a second section 313 at a 90° by a bolt lock 331. Right bottom wing-shaped door 112 has a first section 312 fixedly connected to a second section 314 at a 90° by a bolt lock 332. Left top wing-shaped door 121 has a first section 321 fixedly connected to a second section 323 at a 90° by a bolt lock 333. Right top wing-shaped door 122 has a first section 322 fixedly connected to a second section 324 at a 90° by a bolt lock 334. Left bottom wing-shaped door 111 and right bottom wing-shaped door 112 are connected to bottom section 301 by a first array of hinges 303 and pneumatic actuators 315 and 316 respectively. Left top wing-shaped door 121 and right top wing-shaped door 122 are connected to top section 302 by a second array of hinges 303 and pneumatic actuators 325 and 326 respectively.

Next referring to FIG. 3B, a 2D diagram 300B of the inner structure of top frame section 302 and bottom frame section 301 in accordance with an embodiment of the present invention is illustrated. Central dividing frame 104 is further partitioned by an array of compartment scaffoldings 105. Inside top frame segment 302 and bottom frame segment 301, evaporative cooling pads 341 are used. Because of pneumatic actuators 315-326 and hinges 303, left bottom wing-shaped door 111, right bottom wing-shaped door 112, left top wing-shaped door 121, and right top wing-shaped door 122 can be independently opened and closed. It is noted that when wing-shaped doors 123, 112, 121, and 122 are in closed state, they form shipping container 100. In the open state, they can fold into each other to reduce storing area. More particularly, in the open state, bolt locks 331-334 are loosened so that top wing-shaped doors 121-122 and bottom wing-shaped doors 111-112 are flattened out. Top frame section 302 is inserted inside bottom frame section 301.

Figure 4:
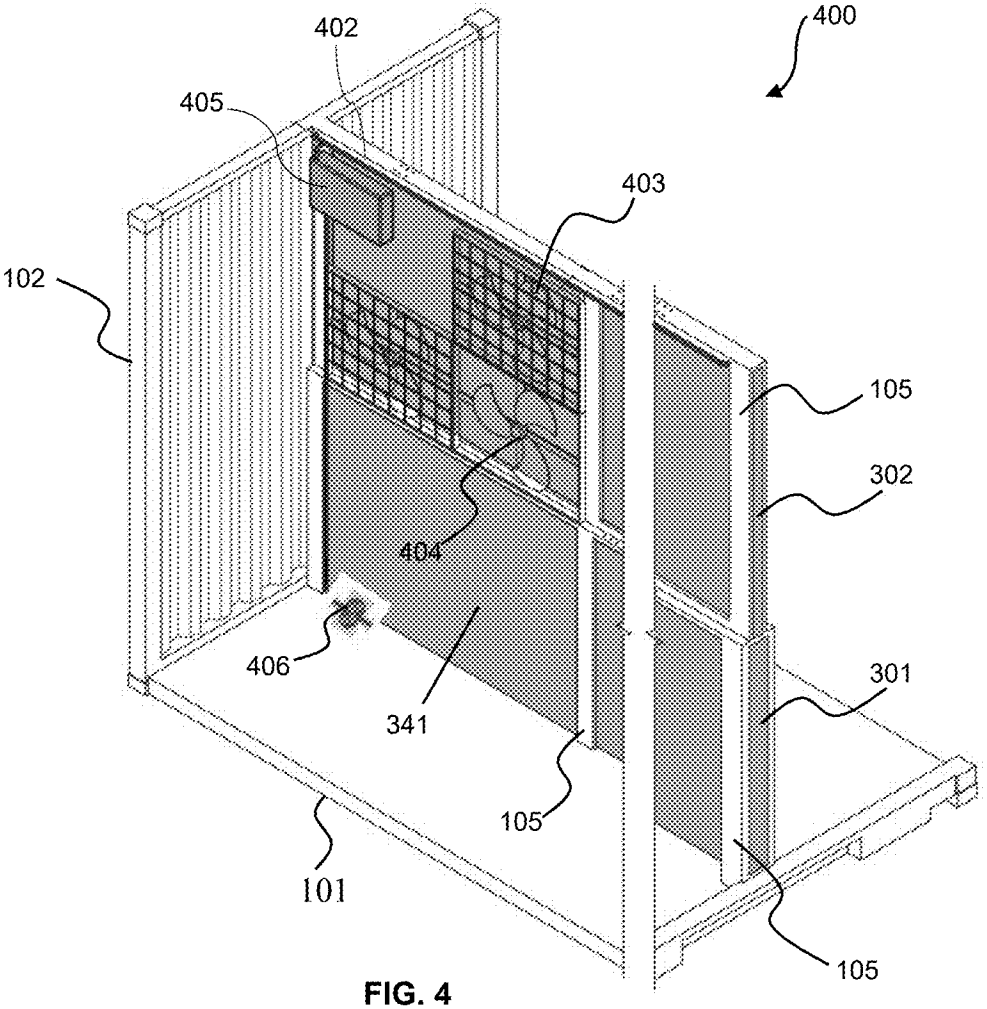
FIG. 4 is a 3D diagram showing the cooling system of the container in accordance with an exemplary embodiment of the present invention.
Figure 5A:
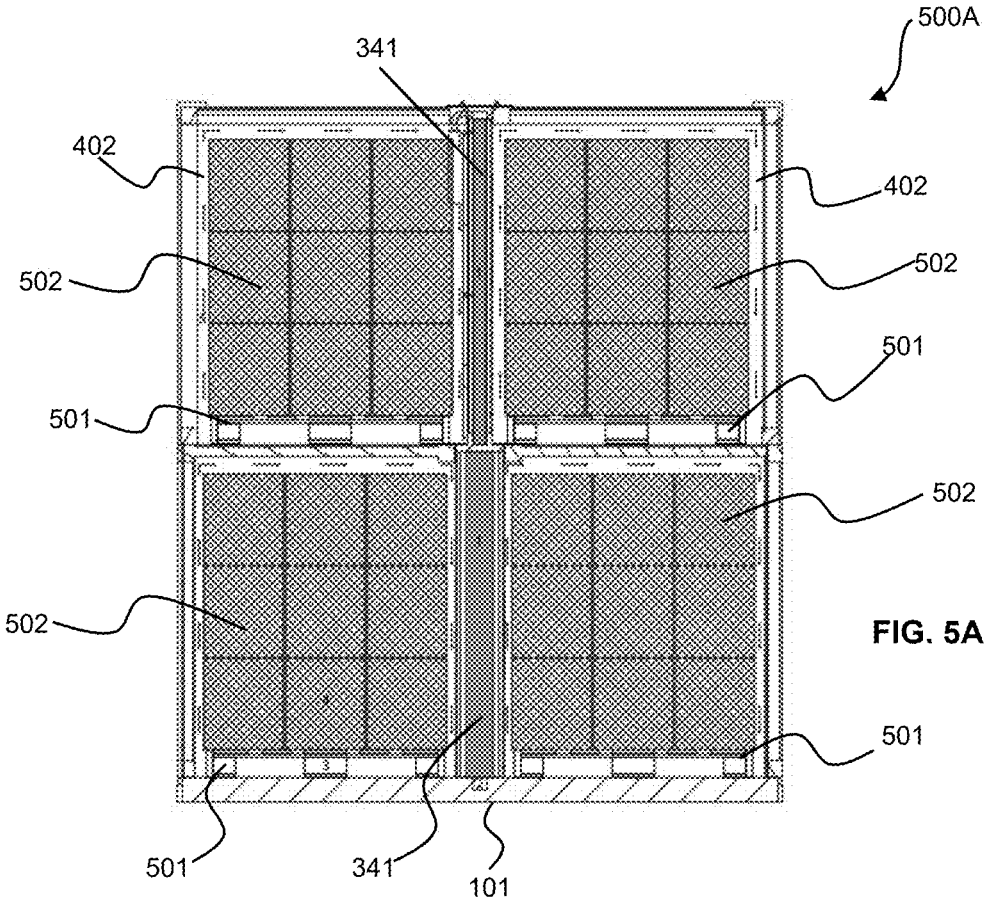
FIG. 5A is a 2D diagram illustrating the shipping container filled with payloads in different storage compartments in accordance with an exemplary embodiment of the present invention.
Figure 5B:
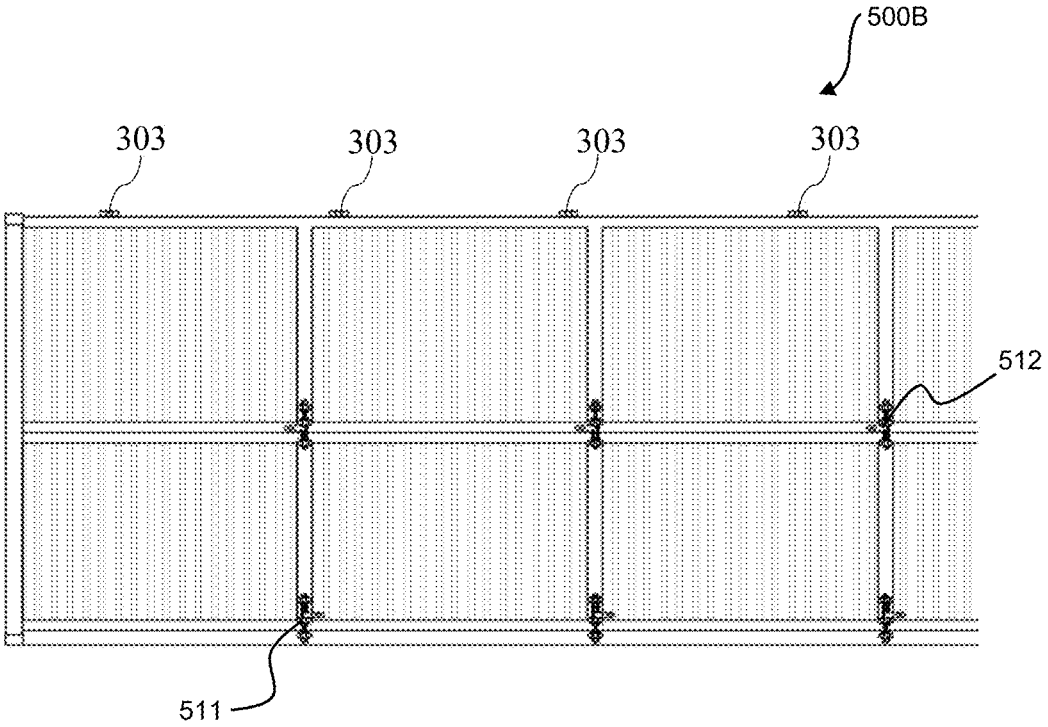
FIG. 5B is a 2D diagram illustrating external bolt lock system of the container in accordance with an exemplary embodiment of the present invention.
Figure 6:
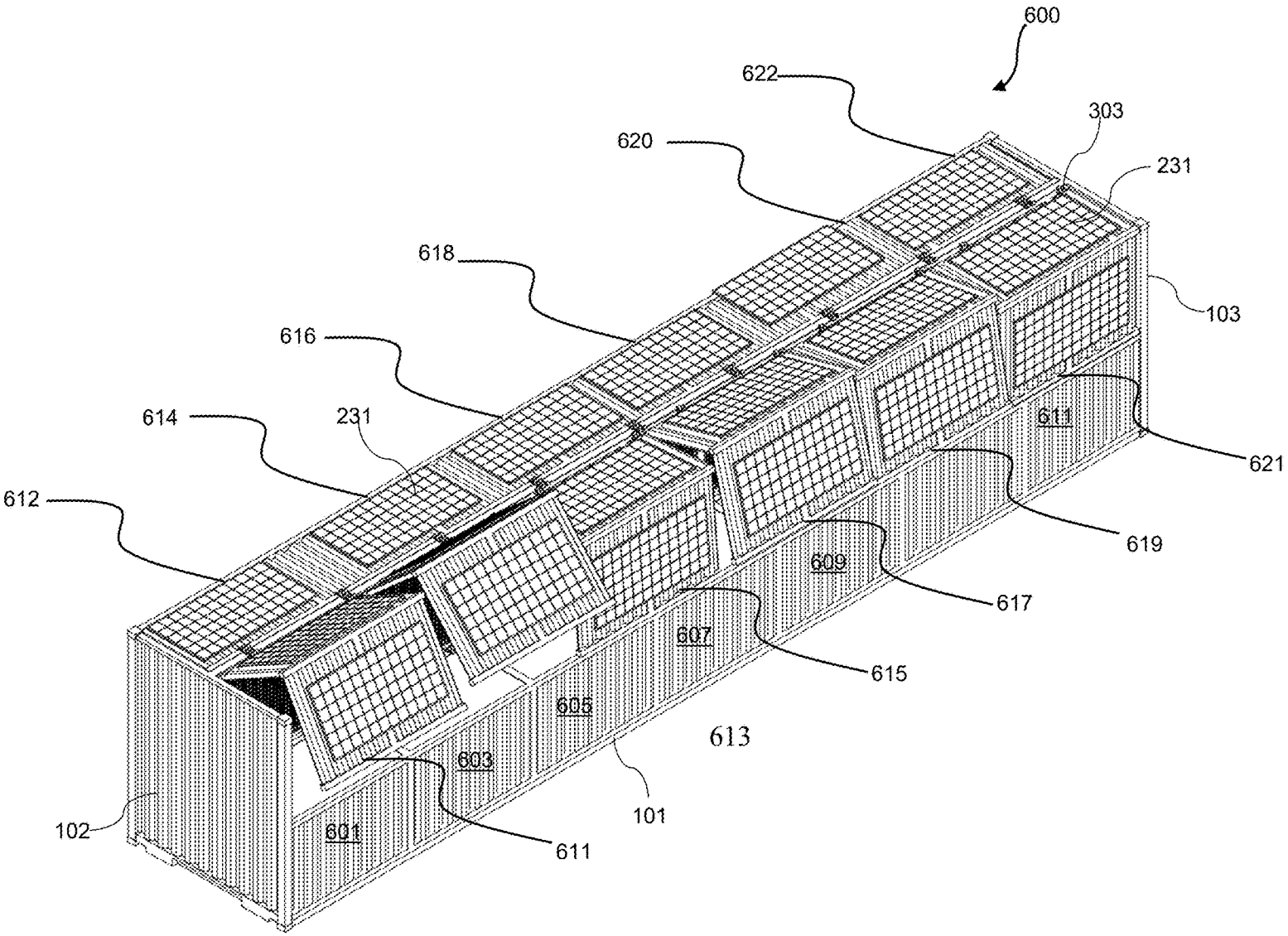
FIG. 6 is a 3D diagram of the container having multiple loading doors and corresponding multiple storage areas in accordance with an exemplary embodiment of the present invention.

Referring next to FIG. 4, a 3D diagram showing a cooling system 400 of shipping container 100 in accordance with an embodiment of the present invention is illustrated. Array of compartment scaffoldings 105 partitions left bottom wing-shaped door 111, right bottom wing-shaped door 112, left top wing-shaped door 121, right top wing-shaped door, 122 bottom frame segment 301, and top frame segment 302 into corresponding three-dimensional (3D) compartments 201-207 and 211-217 respectively. In each of such compartments 201-207 and 211-217, a first direction fan 403 configured to draw the trapped dry hot air from the left hand side through evaporative cooling pad 341. A second direction fan 404 is configured to draw the trapped dry hot air from the right hand side through evaporative cooling pad 341. In the present invention, evaporative cooling pad 341 is used to achieve high efficiency cooling. Evaporative cooling pad 341 consists of specially impregnated and corrugated cellulose paper sheets with different flute angles, one steep angle (60°) and one flat angle (30°) that have been bonded together. Water is circulated through a pump station 405 and supplied to the top of evaporative cooling pad 341 via a distribution manifold 402. In many embodiments of the present invention, distribution manifold 402 is a network of water pipes with drainage holes positioned around the perimeter of each compartments 201-207 and 211-217. The water flows down the corrugated surface of evaporative cooling pad 341. Part of the water is evaporated by the warm and dry air that passes through the pad. The rest of the water assists in washing evaporative cooling pad 341, and is drained back to water pump 405 by a water pump 406. The heat that is needed for the evaporation is taken from the air itself. The air that leaves evaporative cooling pad 341 is therefore cooled and humidified simultaneously throughout shipping container 100.

What is claimed is:

1. A cargo container, comprising:

a bottom side;

a front side connected to said bottom side;

a back side connected to said bottom side and in opposite to said front side;

a central dividing frame; connected to said front side, said back side, and said bottom side; configured to dividing said cargo container into a left storing area and a right storing area, wherein said central dividing frame further comprises a bottom segment vertically coupled to a top segment;

a left top wing-shaped door, hingedly connected to a top side of said central dividing frame on said left storing area, operable to open and close down to the same height level as a top side of said bottom segment;

a left bottom wing-shaped door, hingedly connected to said top side of said bottom segment on said left storing area, operable to open and close down to contact said bottom side;

a right top wing-shaped door, hingedly connected to, said top side of said central dividing frame on said right storing area, operable to open and close down to the same height level as said top side of said top segment;

a right bottom wing-shaped door, hingedly connected to said top side of said bottom segment on said right storing area, operable to open and close down to contact said bottom side; wherein said top segment further comprises a cooling water tank; wherein said top segment and said bottom segment are encircled by an array of reinforcement water pipes, connected to said cooling water tank, having drainage holes designed to release water to said top side of said bottom frame; and a first plurality of locks operative to lock said left top wing-shaped door and said right top wing-shaped door to said left bottom wing-shaped door, and to lock said right bottom winch shaped door to said bottom side so as to form said cargo container with a predetermined width, height, and length.

2. The cargo container of claim 1 wherein said bottom segment is hollow and has the same height and a width greater than that of said top segment.

3. The cargo container of claim 1 wherein said bottom segment further comprises an array of vertical dividing columns, spaced apart evenly and perpendicular to said bottom side, configured to divide said left storing area and said right storing area into a plurality of storage compartments.

4. The cargo container of claim 3 wherein said top segment further comprises a first set of fans operable to blow air in a first direction to said left storing area.

5. The cargo container of claim 4 wherein said top segment further comprises a second set of fans operable to blow air in a second direction to said right storing area in opposite to said first direction.

6. The cargo container of claim 5 wherein said top frame further comprises a first plurality of hinges configured to connect to said right top wing-shaped door and said left top wing-shaped door at said top side.

7. The cargo container of claim 6 wherein each of said right top wing-shaped door and said left top wing-shaped door further comprises a first section and a second section connected together by a first plurality of joints that allows said second section to flexibly rotate against said first section.

8. The cargo container of claim 7 wherein said bottom segment further comprises a third set of fans operable to blow air in said first direction to said left storing area.

9. The cargo container of claim 8 wherein said bottom segment further comprises a fourth set of fans operable to blow air in said second direction to said right storing area in opposite to said first direction.

10. The cargo container of claim 9 wherein said bottom segment further comprises a water pump, in fluid communication to said array of reinforcement water pipes, operative to circulate said cooling water in said top segment and said bottom segment.

11. The cargo container of claim 10 wherein said predetermined width, height, and length are 8 ft, 8.6 ft-9 ft, and 20 ft or 40 ft respectively.

12. The cargo container of claim 11 wherein each of said right bottom wing-shaped door and said left top wing-shaped door further comprises a third section and a fourth section connected together by a second plurality of joints that allow said fourth section to flexibly rotate against said third section.

13. The cargo container of claim 12 wherein said left top wing-shaped door and said right top wing-shaped door are locked to said left bottom wing-shaped door and said right bottom wing-shaped door at said first plurality of joints said second plurality of joints respectively.

14. The cargo container of claim 13 wherein said left bottom wing-shaped door and said right bottom wing-shaped door are locked to outer rims of said bottom sides by said first plurality of locks.

15. The cargo container of claim 14 wherein said first section said top segment is locked to said bottom segment by a second plurality of locks.

16. The cargo container of claim 14 wherein surface areas of said left top wing-shaped door and said right top wing-shaped door each further comprises an array of solar panels.

17. The cargo container of claim 16 wherein said left top wing-shaped door and said right top wing-shaped door each further comprises a first plurality of pistons operable to open and close said left top wing-shaped door and said right top wing-shaped door.

18. The cargo container of claim 16 wherein said left bottom wing-shaped door and said right bottom wing-shaped door each further comprises a second plurality of pistons operable to open and close said left top wing-shaped door and said right top wing-shaped door.

19. The cargo container of claim 16 wherein said left bottom wing-shaped door, said right bottom wing-shaped door, said left top wing-shaped door, and said right top wing-shaped door each further is divided into a plurality of independently closed and opened side doors along their lengths.

20. The cargo container of claim 18 wherein said first plurality of pistons and said second plurality of pistons are pneumatic cylinder actuators.

* * * * *